US009138871B2

(12) United States Patent
Field et al.

(10) Patent No.: US 9,138,871 B2
(45) Date of Patent: Sep. 22, 2015

(54) DRYWALL SANDER

(75) Inventors: Craig M. Field, Traunik, MI (US); Jeffrey L. Trudeau, Marquette, MI (US)

(73) Assignee: EC Sander, L.L.C., Traunik, MI (US)

( * ) Notice: Subject to any disclaimer, the term of this patent is extended or adjusted under 35 U.S.C. 154(b) by 603 days.

(21) Appl. No.: 12/986,799

(22) Filed: Jan. 7, 2011

(65) Prior Publication Data

US 2011/0124274 A1 May 26, 2011

Related U.S. Application Data

(60) Continuation-in-part of application No. 12/239,152, filed on Sep. 26, 2008, now Pat. No. 7,867,064, which is a division of application No. 11/636,185, filed on Dec. 8, 2006, now Pat. No. 7,497,765.

(60) Provisional application No. 60/748,781, filed on Dec. 9, 2005.

(51) Int. Cl.
*B24D 15/04* (2006.01)
*B24B 7/18* (2006.01)

(52) U.S. Cl.
CPC ..... *B24D 15/04* (2013.01); *B24B 7/184* (2013.01)

(58) Field of Classification Search
CPC ..... B24D 15/02; B24D 15/023; B24D 15/04; A47L 13/20
USPC ..... 451/502, 514, 515, 523, 524, 525
See application file for complete search history.

(56) References Cited

U.S. PATENT DOCUMENTS

| | | | | | |
|---|---|---|---|---|---|
| 2,922,177 | A * | 1/1960 | Hudson | 401/207 |
| 3,073,084 | A * | 1/1963 | Howard | 451/515 |
| 3,166,775 | A * | 1/1965 | Cushman | 15/228 |
| 3,192,678 | A * | 7/1965 | Buratti | 451/522 |
| 3,720,976 | A * | 3/1973 | Bailey | 15/244.2 |
| 4,825,597 | A * | 5/1989 | Matechuk | 451/524 |
| 5,168,672 | A * | 12/1992 | Gregoire, Sr. | 451/502 |
| 5,337,523 | A * | 8/1994 | Walsh | 451/502 |
| 5,507,065 | A * | 4/1996 | McBride et al. | 15/228 |
| 5,605,500 | A * | 2/1997 | Matechuk | 451/456 |
| 5,678,278 | A * | 10/1997 | McBride et al. | 15/228 |
| 6,296,558 | B1 * | 10/2001 | Poole et al. | 451/557 |
| 6,790,135 | B2 * | 9/2004 | Yang | 451/490 |
| 7,485,031 | B1 * | 2/2009 | Stubbs | 451/523 |
| 7,815,494 | B2 * | 10/2010 | Gringer et al. | 451/344 |
| 7,867,064 | B2 * | 1/2011 | Field et al. | 451/344 |
| 8,469,775 | B2 * | 6/2013 | Dow et al. | 451/59 |
| 8,578,545 | B2 * | 11/2013 | Wolf et al. | 15/118 |
| 2008/0207099 | A1 * | 8/2008 | Brown | 451/524 |
| 2010/0065082 | A1 * | 3/2010 | Dinh | 134/6 |

* cited by examiner

*Primary Examiner* — Maurina Rachuba
(74) *Attorney, Agent, or Firm* — Price Heneveld LLP

(57) ABSTRACT

A drywall sander includes a replaceable sanding pad having a layer of resilient material, and an abrasive surface. The sanding pad includes one or more edge portions that project beyond the edges of a sander head. The edges of the sanding pad can be deformed during use when the sander is used in a corner or the like to thereby prevent scuffing or other damage to adjacent orthogonal surfaces.

22 Claims, 18 Drawing Sheets

DRYWALL SANDER

CROSS-REFERENCE TO RELATED APPLICATIONS

The present application is a continuation-in-part of U.S. patent application Ser. No. 12/239,152, filed on Sep. 26, 2008, which is a divisional of U.S. patent application Ser. No. 11/636,185, filed Dec. 8, 2006, which claims the benefit of U.S. Provisional Application No. 60/748,781, entitled DRYWALL SANDER, filed on Dec. 9, 2005, the entire contents of each of which are hereby incorporated by reference.

BACKGROUND OF THE INVENTION

Various types of sanders for sanding drywall and the like have been developed. Drywall sanders typically include a rectangular head that is pivotably attached to an elongated handle. The head includes clamps or the like for removably securing a piece of sandpaper to the sanding head.

Although known drywall sanders have been somewhat effective, they suffer from several disadvantages/drawbacks. For example, available sandpaper for such sanders may tear relatively easily during use, thereby requiring that the user stop sanding and replace the sandpaper. Also, existing sandpaper tends to become loaded up quickly, thereby reducing the effectiveness of the sandpaper. Once the sandpaper becomes loaded up, it must be replaced. The need to frequently replace the sandpaper increases the amount of time required to complete a job, and also adds to the cost of materials.

Also, known drywall sanders may support the sandpaper in a way that makes it difficult to obtain a surface having the desired smoothness. Furthermore, the edges of the sander head may come into contact with other wall surfaces when sanding in corners. The sander head may also contact mouldings, door and window frames, and the like. This contact may scratch or cause other such damage to these surfaces.

Accordingly, a drywall sander alleviating the above-identified drawbacks of existing drywall sanders would be beneficial.

SUMMARY OF THE INVENTION

One aspect of the present invention is a drywall sander assembly including a unique replaceable sanding pad having a resilient foam layer and flexible extensions or wings that extend from opposite sides of the pad. The sander assembly includes a sanding head having a generally rectangularly-shaped body portion having opposed parallel side edges defining a first width, and spaced-apart opposite end edge portions defining a first length. The sanding head further includes releasable retainers adjacent to the end portions of the sanding head for retaining a flexible sanding member on the sanding head. The sanding head defines a first side having a generally flat end surface configured to support a flexible sanding member, and a second side opposite the first side. The drywall sander assembly further includes an elongated handle member having a first end that is pivotally connected to the sanding head. The elongated handle extends away from the second side of the sanding head such that the angular position of the handle relative to the head can be changed when a user is sanding a wall or the like.

The replaceable sanding pad or member defines a generally quadrilateral perimeter having end portions defining a second length that is greater than the first length. The perimeter has opposite side edges defining a second width that is greater than the first width. The replaceable sanding member has a layer of resilient foam defining first and second opposite sides, and includes abrasive material on the first side thereof. The end portions of the replaceable sanding member wrap around the end portions of the body of the sanding head. The releasable retainer is engaged to the end portions of the sanding member to retain the sanding member on the sanding head. The replaceable sanding member includes opposite side edge portions that project beyond the side edges of the body portion of the sanding head to define resilient wings having a first shape when the resilient wings are not in contact with an object other than the sanding head. In use, the resilient wings deform to a second shape that is different from the first shape upon contact with an object. The resilient wings return to the first shape when the resilient wings are no longer in contact with an object.

In the foregoing description, it will be readily appreciated by those skilled in the art that modifications may be made to the invention without departing from the concepts disclosed herein. Such modifications are to be considered as included in the following claims, unless these claims by their language expressly state otherwise.

DETAILED DESCRIPTION OF PREFERRED EMBODIMENT

Figure 1:
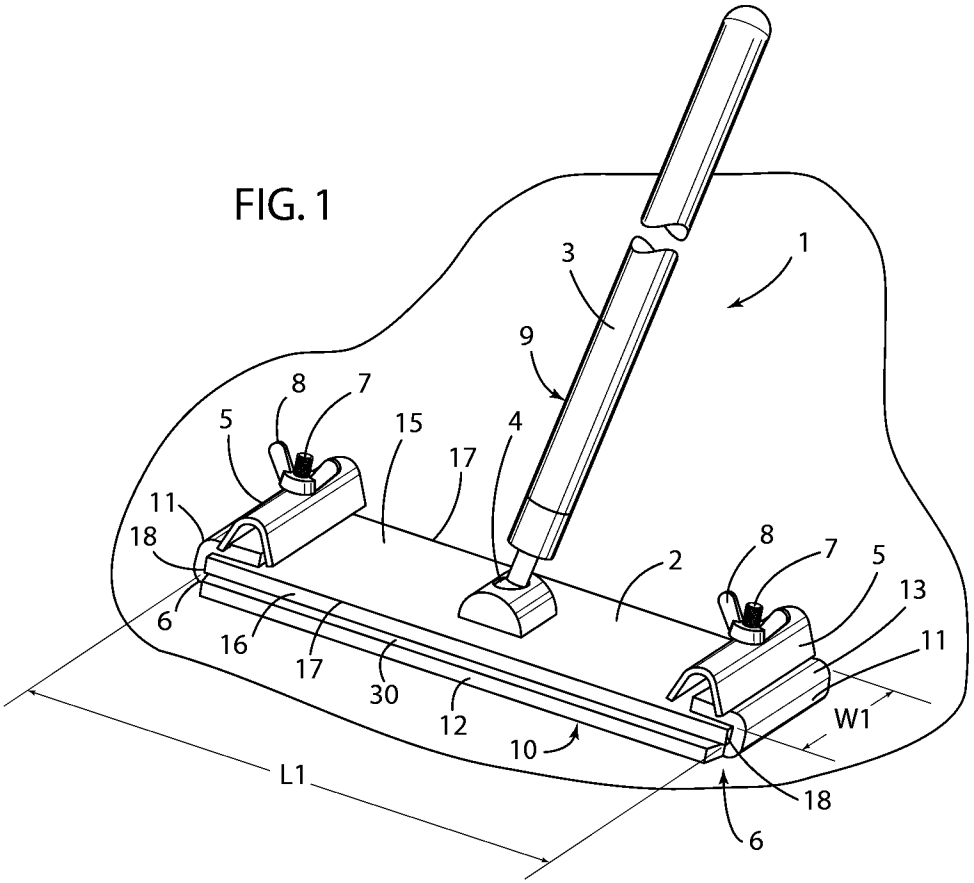
FIG. 1 is a partially fragmentary isometric view of a drywall sander assembly according to one aspect of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
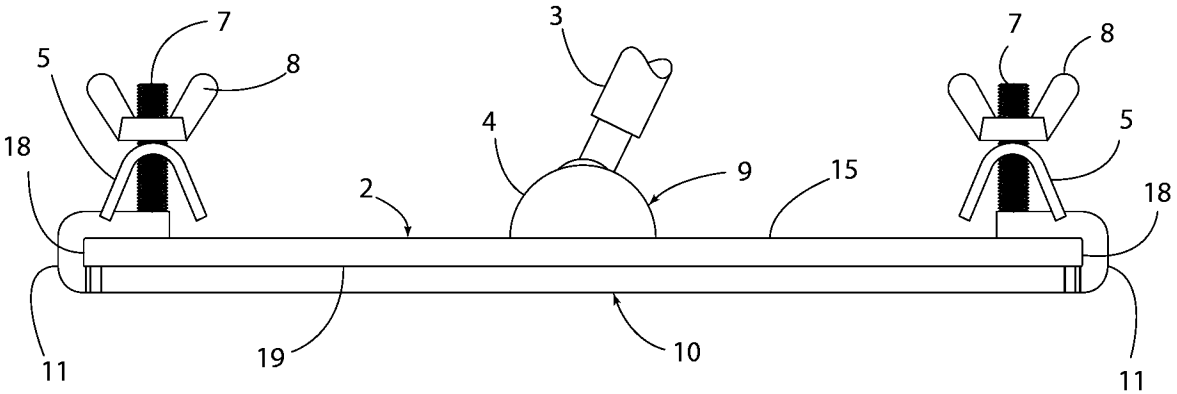
FIG. 2 is a front elevational view of a portion of the drywall sander of FIG. 1.
Figure 7:
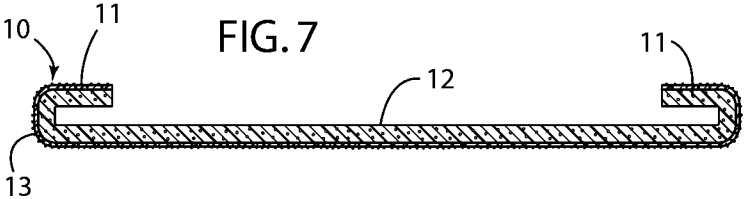
FIG. 7 is a cross-sectional view of the sanding member of FIG. 5 taken along the line VII-VII.
Figure 6:
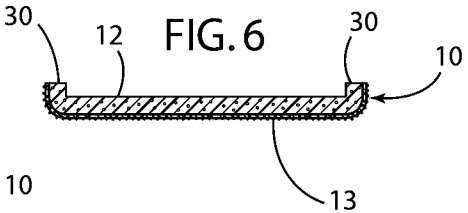
FIG. 6 is a cross-sectional view of the sanding member of FIG. 5 taken along the line VI-VI.

With reference to FIG. 1, a drywall sander 1 according to one aspect of the present invention includes a drywall sander 9 of a known design, with a unique replaceable sanding pad 10 attached thereto. Sander 9 includes a head 2, and an elongated handle 3 that is pivotably connected to the head 2 by a pivotable connector 4. A pair of clamp members 5 of sander 9 are connected to the opposite end portions 6 of head 2 by threaded studs 7 and wing nuts 8. As described in more detail below, a unique replaceable sanding pad 10 includes a layer of resilient foam material 12 (see also FIGS. 6 and 7) and an outer abrasive surface 13. The combination of a layer of foam 12 and an abrasive outer surface 13 facilitates sanding irregular wall surfaces, inside corners of walls, and other objects such as door frames or the like protruding from the surface being sanded. End portions 11 of sanding pad 10 wrap around ends 6 of head 2, and clamps 5 engage end portions 11 to retain pad 10. The head 2 of sander 9 includes a body portion 15 having a generally rectangular perimeter 16 with opposite side edges 17 and end edges 18. The end edges 18 define a length L1 of the body 15, and the opposite side edges 17 define a width W1. The sanding head 2 may include a layer of foam, rubber or the like that is permanently bonded to a lower side 19 (FIG. 2) of body portion 15. Sanding head 2 may be that of, for example, a Marshalltown Model 26 sander. This sanding head includes a rectangular metal portion having a width of about 3¼ inches, and a length of about 9⅜ inches. This sanding head also includes a rubber pad to cushion conventional sandpaper attached to the head. The rubber pad has initial dimensions (when new) of about 3⁵⁄₁₆ (or 3⅜ inches) inches by about 9⅛ inches. However, after a period of use, the edges of the rubber pad tend to wear down until the width of the rubber pad is the same as the metal portion of the sanding head. It will be understood that the head 2, handle 3, pivotable connection 4, and clamp members 5, as well as threaded studs 7 and wing nuts 8 comprise an existing prior art drywall sander 9. Accordingly, these components will not be described in further detail herein. Also, it will be understood that other types of known drywall sanding heads and clamping/sandpaper securing arrangements are known. The inventive replaceable sanding head 10 may be used with virtually any such known drywall sanders.

Figure 3:
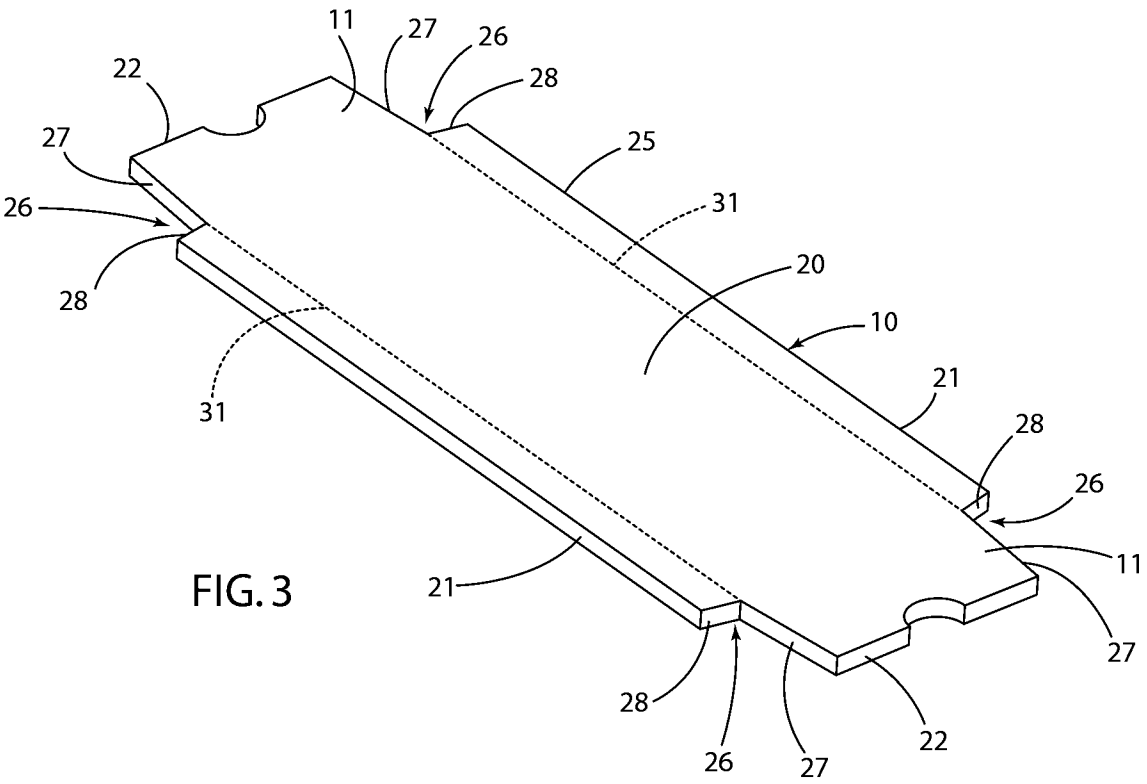
FIG. 3 is an isometric view of a replaceable sanding member according to one aspect of the present invention.
Figure 4:
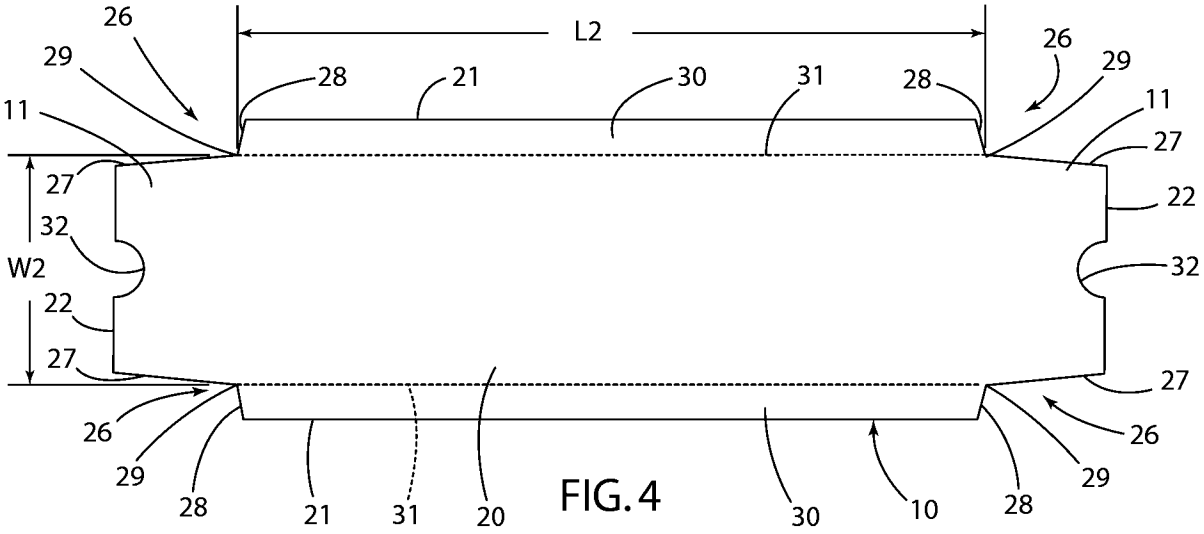
FIG. 4 is a plan view of the sanding member of FIG. 3.

The sanding pad 10 includes a central portion 20 (FIG. 3), and a peripheral edge 25 including opposite side edges 21 that are generally parallel to one another. The peripheral edge or perimeter 25 is generally rectangular, with end edges 22 and notched corners 26. Notched corners 26 define first and second edge portions 27 and 26, respectively, that intersect to define a corner 29. Edge portions 27 are approximately parallel to opposite side edges 21, and second edge portions 28 are transverse to the opposite side edges 21. In the illustrated example, the first edge portions 27 extend towards one another, forming an angle of about five degrees (5°) relative to the opposite side edges 21. Also, the second edge portions 28 are angled about ten degrees (10°) relative to the end edges 22, such that the angle between the edge portions 27 and 28 at corners 26 is about one hundred and five degrees (105°). The dimension "W2" between the corners 29 is about the same as the width W1 of head 2 (FIG. 1). Also, the length L2 (FIG. 4) between the corners 29 is approximately the same as the length L1 of head 2 (FIG. 1). End edges 22 of end portions 11 of pad 10 (FIG. 4) include a concave cutout 32 that provides clearance for threaded stud (FIG. 1) when pad 10 is installed to pad 2.

Dashed lines 31 extending between corners 29 represent the position of opposite side edges 17 of head 2 when sanding pad 10 is installed to the head 2. The area between dashed lines 31 and opposite edges 21 form "wings" or tabs 30 that project beyond the edges 17 of head 2 a distance equal to the distance between lines 31 and edges 21 when replaceable sanding pad 10 is installed on head 2. As described in more detail below, the wings or tabs 30 are resilient due to the foam layer 12 of sanding pad 10, and facilitate sanding corners formed by walls, mouldings, or other objects protruding from the surface being sanded. In the illustrated example, the distance between dashed lines 31 and edges 21 about ⅜ to ½ inch. However, the wings 30 could project as little as ⅛ inch (0.125 inch) or less, or as much as ¾ inch (0.750 inch) or more. As discussed above, the sanding head 2 includes a metal portion having a width of about 3¼ inches, and a rubber pad having a width of about 3⁵⁄₁₆ inches (when new). Thus, the total width of sanding pad 10 (i.e., dimension between edges 21) is preferably greater than 3⁵⁄₁₆ inches. In the illustrated example, the total width of sanding pad 10 is about 4¹⁄₁₆ to about 4⁵⁄₁₆ inches (i.e., 3⁵⁄₁₆ inches plus two wings of ⅜ to ½ inch each). However, the pad 10 could have a width as small as 3⁷⁄₁₆ inches (the width of the metal portion of the sander head and rubber pad after it wears down is 3³⁄₁₆ inches plus two ⅛ inch wings 30) or as large as 4¹³⁄₁₆ inches (3⁵⁄₁₆ inches wide rubber pad on head 2, when new, plus two ¾ inch wings). In a preferred embodiment, the width of the pad is about 4¼ inches. The ends 11 of sanding pad 10 preferably provide enough length to wrap around end edges 18 of head 2. End portions 11 of pad 10 are preferably at least about an inch long, such that the total length of pad 10 is at least about two inches longer than head 2. In a preferred embodiment, the total length of pad 10 is about 12¼ inches. However, end portions may be as small as ½ inch, ⅜ inch, or less.

Figure 8:
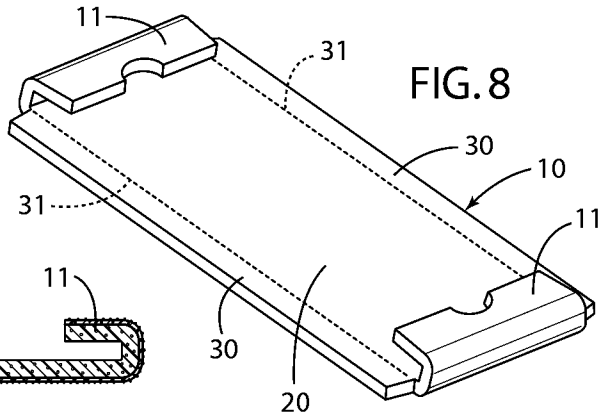
FIG. 8 is an isometric view of the sanding member showing the ends wrapped around, and the wings in a flat configuration.
Figure 5:
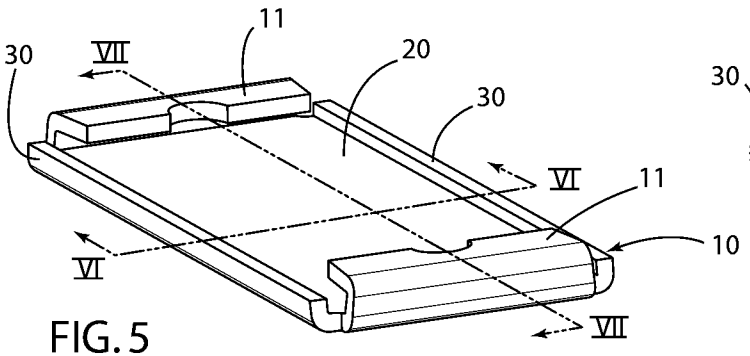
FIG. 5 is an isometric view of the sanding member of FIG. 3 showing the ends and wings in flexed/deformed configurations.

FIG. 5 shows the shape of end portions 11 of sanding pad 10 when installed to head 2. Wings 30 are shown in an upwardly-folded or deformed configuration (FIGS. 5 and 6) representing the shape that wings or tabs 30 would take if sanding pad 10 were installed to head 2, and the wings 30 were brought into contact with an object to thereby deform wings 30 so they abut opposite side edges 17 of head 2 (FIG. 1). However, it will be understood that wings 30 have a flat shape that is co-planar with the central portion 20 of sanding pad 10 as shown in FIG. 8 when wings 30 are in a free state such that they are not in contact with a protrusion or the like projecting from the surface being sanded. The end portions 11 of replaceable sanding pad 10 are configured to wrap around the opposite end portions 6 of pad 2, with clamp member 5 (FIG. 1) in engagement with the end portions 11 to thereby secure the replaceable pad 10 to the head 2 (see also FIG. 7).

In the illustrated example, the foam layer 12 is about 3/16 inch (0.1875 inch) thick. However, the foam layer 12 may be as thin as 1/16 inch (0.0625 inch) (or less) thick, or as thick as one inch (1.0 inch). In the illustrated example, the foam layer 12 has a substantially uniform thickness. However, foam layer 12 could have varying thickness. For example, end portions 11 could be thinner to facilitate wrapping of the end portions 11 around the ends 6 of head 2. The foam layer 12 comprises a polymer foam such as a polyurethane or polyethylene foam. Although the type of foam material and the thickness of the foam may vary, the foam layer 12 preferably provides sufficient rigidity to insure that the wings 30 return to the flat configuration shown in FIGS. 1 and 8 when the wings 30 are not in contact with a protrusion or orthogonal wall surface. However, the foam layer 12 preferably has sufficient flexibility to permit the end portions 11 to be deformed to permit installation of sanding pad 10 to head 2. Also, the foam layer 12 has enough flexibility to permit the wings 30 to be deformed without application of excessive force when the wings 30 are brought into contact with an orthogonal wall surface at a corner, or an orthogonal surface of an object protruding from the wall surface being sanded. In the illustrated example, the abrasive surface 13 comprises 80 grit. Although this grit has proven to be effective, other grits forming an abrasive surface may also be utilized. For example, the abrasive surface 13 may have virtually any grit, and could comprise a grit as coarse as 36, or as fine as 220. In the illustrated example, the grit comprises aluminum oxide material. However, other abrasive surfaces that do not utilize conventional grit could also be utilized. Also, the sanding pad may include a layer of cloth or the like (not shown) between the foam material and the abrasive to increase the strength of the pad and thereby increase the useful life of the pad.

The replaceable sanding pad 10 provides numerous advantages over conventional sandpaper. For example, when sanding a drywall surface adjacent a vertical door moulding, the wings 30 will flex to thereby sand the door frame surfaces that are orthogonal to the drywall surface. The wings 30 also prevent damage or scuffing that could otherwise result from head 20 coming into contact with the door frame. Also, when sanding a corner formed by orthogonal drywall surfaces, the wings 30 flex upwardly, thereby permitting sanding into corners without scuffing or damaging either of the orthogonal wall surfaces. The wings 30 also flex to adapt to virtually any other corner configuration or the like that may be present.

Furthermore, the wings 30 provide extra stability for the sanding head 2, and thereby reduce the likelihood that the sanding head 2 will inadvertently flip or pivot about pivotable connector 4 when the sanding head 2 is being moved in a side-to-side direction (i.e., transverse to opposite edges 17). Similarly, the head 2 can be moved in a circular motion without flipping over. Also, the thickness of pad 10 spaces the head 2 from the surface being sanded. As discussed above, existing sanding heads 2 may include a rubber layer. If conventional sandpaper is used, the rubber layer may contact the surface being sanded, causing the sanding head to flip, especially if the surface is rough/irregular due to drywall tape or other surface irregularities. The sanding pad 10 spaces the rubber pad (not shown) of sanding head 10 from the surface being sanded, thereby preventing the rubber pad from contacting the surface being sanded and reducing or eliminating the tendency of the sanding head to flip. Thus, sanding pad 10 reduces the tendency of head 2 to flip both by increasing the effective width of the sanding head due to wings 30, and by eliminating or reducing the tendency for the head 2 to contact the surface being sanded.

Still further, when sanding a drywall surface directly adjacent an outside corner of a door frame or the like, one of the wings 30 can be brought into contact with the corner. The wing 30 will deform, and thereby sand the orthogonal outside surfaces of the door frame adjacent the corner while the central portion 20 of pad 10 is in contact with the drywall surface. When used in this way, the head 2 is generally positioned such that the opposite edges 17 are at about a 45 degree angle relative to the outer surfaces of the door frame being sanded. Yet another advantage of the sanding pad 10 is that the resilient nature of the foam layer 12 facilitates sanding of irregular surfaces, such that a user can more quickly provide a finished surface. Still further, the abrasive surface 13 is less prone to loading up during sanding, further enhancing the sanding process. Also, the pad 10 can be cleaned in water or other suitable fluid and reused. Thus, sanding pad 10 greatly facilitates sanding of drywall surfaces, and also substantially reduces the need to replace the sanding media compared to conventional sandpaper.

Figure 9:
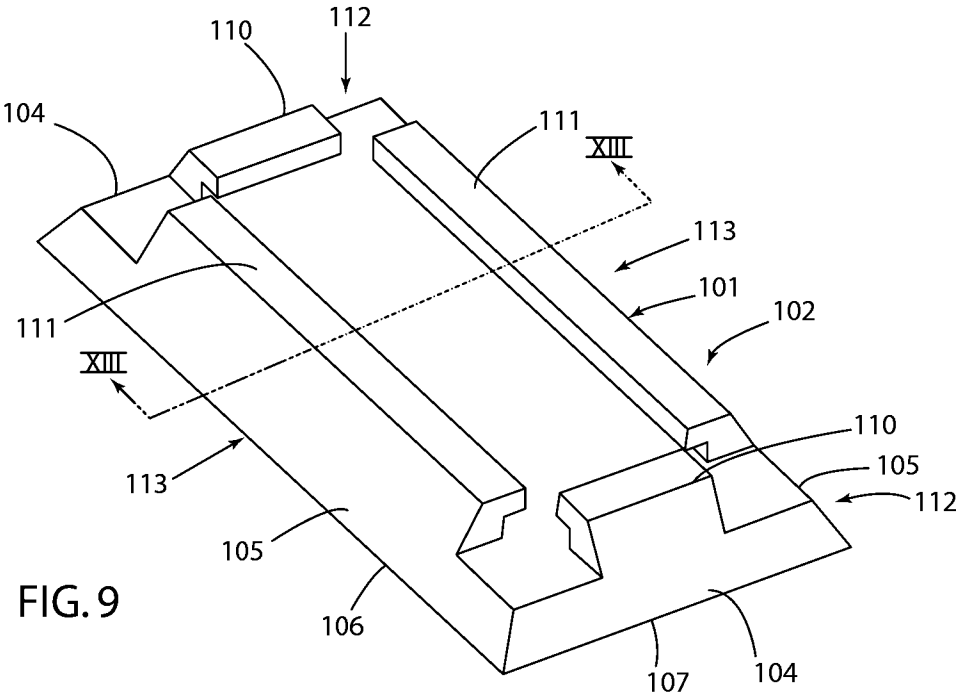
FIG. 9 is a perspective view of a drywall sander according to another aspect of the present invention.
Figure 10:
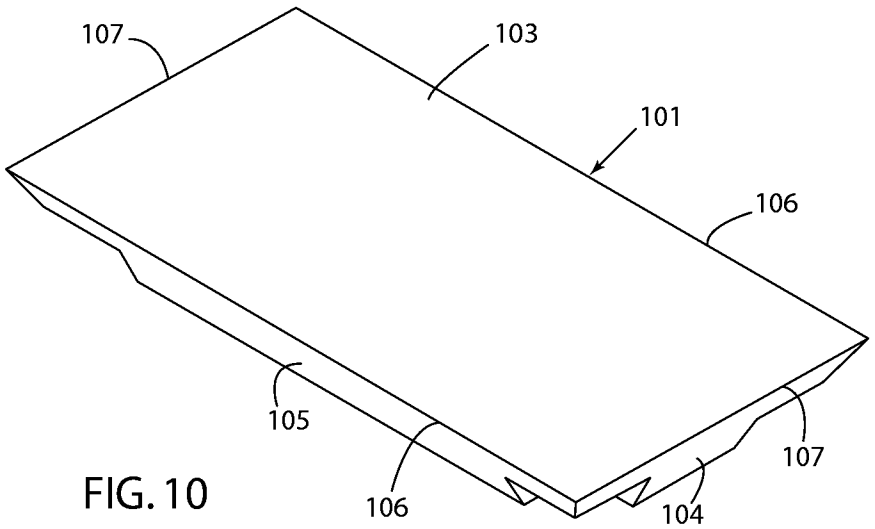
FIG. 10 is a perspective view of the drywall sander of FIG. 9 from a different angle.
Figure 11:
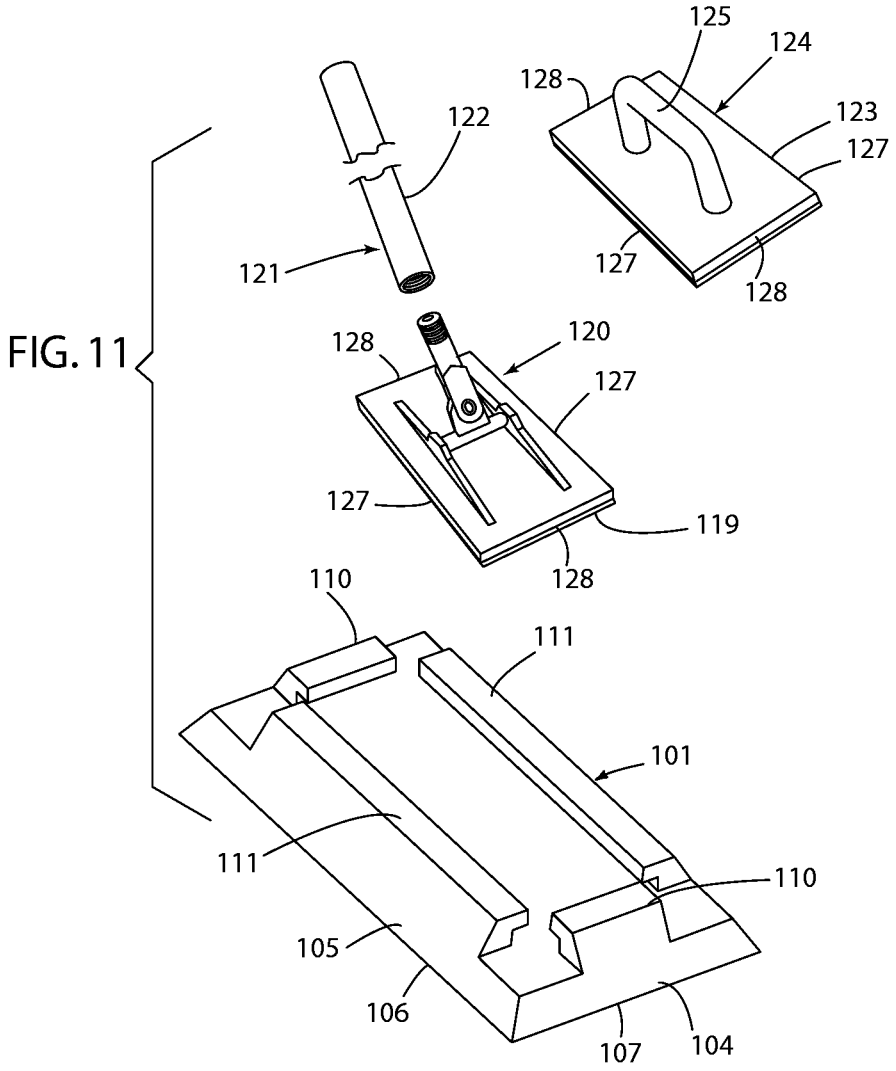
FIG. 11 is an exploded perspective view of the drywall sander of FIG. 91 and two examples of commercially available drywall sanding tools having rectangular sanding heads.

A drywall sander 101 (FIGS. 9 and 10) according to another aspect of the present invention includes a body 102 having a generally planar main surface 103 and side surfaces 104 and 105 that extend inwardly from the main surface at an acute angle $\alpha$ (FIG. 13) to form sharp edges 106 and 107. Although angle $\alpha$ is preferably an acute angle in the range of about forty-five degrees to about eighty-five degrees, and more preferably about sixty-five degrees, angle $\alpha$ may be ninety degrees, or it may be an obtuse angle. As discussed in more detail below, body 102 is made of a flexible foam material that is at least partially covered by abrasive material. The body 102 includes retaining tabs 110 at opposite ends 112 of body 102, and elongated retaining tabs 111 along opposite sides 113 of body 102. Retaining tabs 111 include an inwardly extending portion 114 defining opposed slots 115. It will be understood that the retaining tabs 110 have substantially the same shape as retaining tabs 111. With reference back to FIG. 11, the sander 101 may be connected to a rectangular head 120 of a commercially available drywall sander 121 having an elongated handle or pole 122. Alternately, the sander 101 may be secured to the rectangular plate-like portion 123 of a conventional drywall sander 124 having a handle 125.

Figure 12:
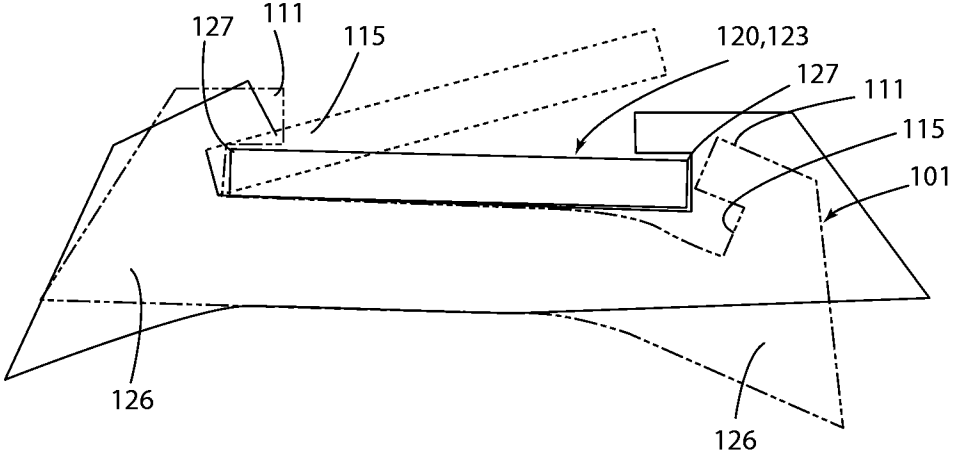
FIG. 12 is a partially schematic view showing flexing of the sander of FIG. 9 to install the sander to the head of a drywall sanding tool.

With further reference to FIG. 12, the sander 101 can be installed to a rectangular sander head 120 or plate 123 by flexing the edge portions 126 downwardly to permit insertion of edge portions 127 of head 120 or plates 123. The retaining tabs 110 can be flexed to permit insertion of end portions 128 of head 120 or plate 123 in substantially the same manner as just described for retaining tabs 111.

Figure 13:
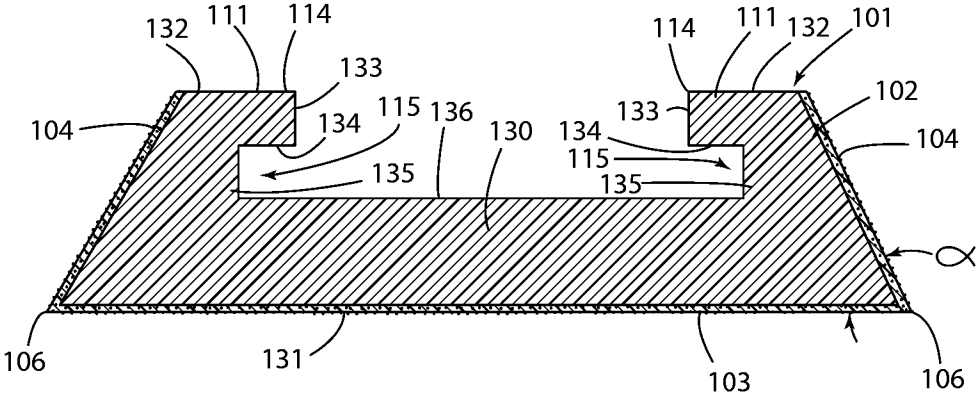
FIG. 13 is a cross-sectional view of the sander of FIG. 9 taken along the line XII-XII.

With reference to FIG. 13, the body 102 includes a foam core 130 with an abrasive material such as sandpaper adhered or otherwise fixed to the main surface 3 and side surfaces 4 and 5. The surfaces may also be covered or coated with an abrasive material such as granular material 131. The other surfaces 132-136 may also be covered with sandpaper or abrasive material 131.

The sander 101 can be quickly and easily attached to a variety of commercially available drywall sanders. The angled side surfaces 4 and 5 permit sanding in corners and the like having limited access. Also, because the foam is somewhat flexible, the retaining tabs 110 and 111 will retain the sander 101 on a variety of drywall sanders of somewhat different configurations. Also, the flexibility of the foam material allows the sander 101 to sand irregular, non-planar surfaces having concave and/or convex portions. For example, commercially available drywall sander heads 120 (FIG. 11) may include a layer of foam 119 for use with conventional sandpaper. However, the foam 119 may deteriorate and become uneven or detach from the head 20. The retaining tabs 110 and 111 are configured to provide sufficient grip to retain the sander 101 on a head 120 regardless of whether or not a layer of foam 119 is present.

With reference to FIGS. 14-17, a sander 150 according to yet another aspect of the present invention includes a body 52 having angled surfaces 154 and 155, and a main surface 153. The body 152 is made of a foam material, and the outer surfaces of the body 102 are covered with an abrasive material in substantially the same manner as described above in connection with the sander 101.

Sander 150 includes a cavity 156 having sidewalls 157 and 158, and a flat base surface 159. The cavity 156 may include corners 160 that are radiused as shown (e.g., FIG. 15), the corners 160 may be a sharp corner (not shown). The radiused corners 160 are deformed upon insertion of a rectangular drywall sanding head, thereby retaining the sander 150 on the drywall sanding head.

Figure 18:
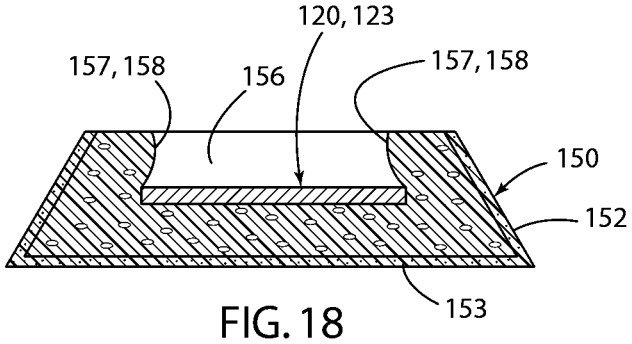
FIG. 18 is a cross-sectional view of the sander of FIG. 14, showing the sander connected to a sander head.
Figure 19:
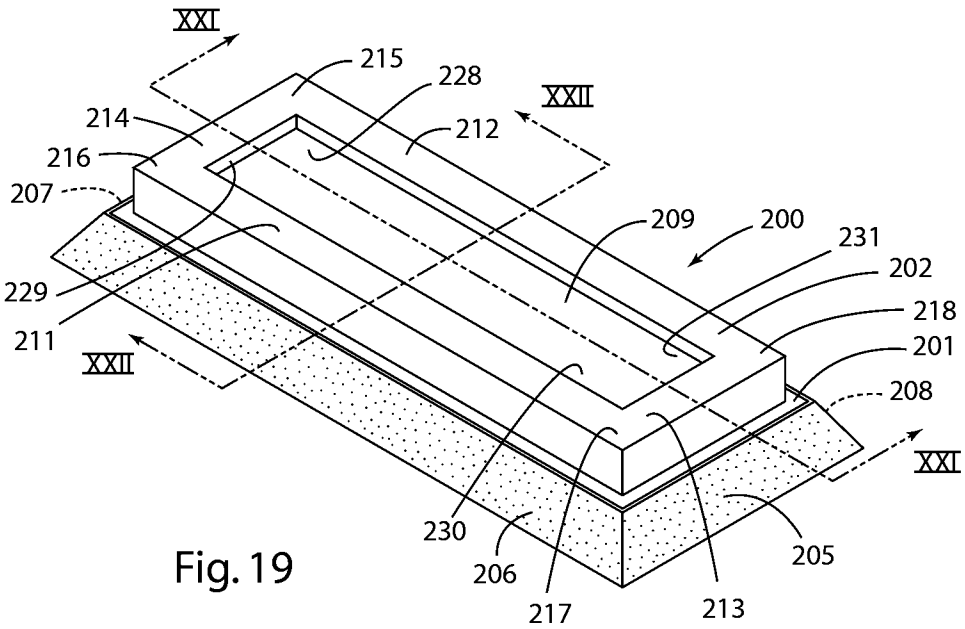
FIG. 19 is an isometric view of a multi-piece sanding pad according to another aspect of the present invention.

Sander 150 is secured to a sanding head 20 or plate-like portion 123 (FIG. 11) by inserting the head 120 or plate-like portion 123 into the cavity 156. As shown in FIG. 18, when the head 110 or plate-like portion 123 is inserted into the cavity 156, the foam material of the body 152 deforms, thereby retaining the sander head in the cavity 156. The dimensions (i.e., distance between sidewalls 157, and the distance between sidewalls 158) of cavity 156 may be somewhat smaller than the dimensions of the head 120 or plate-like portion 123 to thereby retain the sander 150 to the head 120 or plate-like portion 123. Alternately, the dimensions of cavity 156 (i.e., distance between sidewalls 157 and sidewalls 158) may be the same, or about the same, as the dimensions of a rectangular drywall sanding head. If the dimensions of the cavity are about the same size as the rectangular sanding head, the radiused (filleted) corners 160 are the primary feature that retains sander 150 to a drywall sander head. Also, deformation of radiused corners 160 due to engagement with the sharper corners of a drywall sander head causes the layer of foam between surfaces 153 and 159 to be in tension. This tension tends to pull/retain surface 153 in a planar shape. In contrast, if the length (i.e., the distance between surfaces 158) and/or width (i.e., the distance between surfaces 157) of cavity 156 are significantly smaller than the length and width of a sander head, the forces on surfaces 157 and 158 will tend to deform surface 153 into a concave shape. The concave shape tends to cause the center portion of surface 153 to lose contact with a surface that is being sanded. The radiused corners 160 preferably have a radius of about 0.50 inches. In general, the radius is preferably in the range of about 0.25 inches to about 0.75 inches. However, the radius could be smaller (e.g., 0.125 or 0.060 inches) or larger (e.g., 1.00 inches or more). The optimal size of the radius may vary somewhat depending on the density/resiliency of the foam. If sander 150 comprises higher density (less resilient) foam, smaller radiuses (e.g., 0.25 inches to 0.375 inches) may be utilized. If sander 150 comprises lower density (more resilient) foam, the radiuses may be somewhat larger (e.g., 0.50 inches to 0.75 inches). The dimensions of the radiuses are selected to ensure that sander 150 can be installed on a drywall sander head, while also ensuring that sander 150 is retained on the drywall sander head with surface 153 being in a planar state. Although corners 160 are preferably radiused, other shapes may also be utilized to create interference with the corners of a drywall sander head to retain sander 150 on a drywall sander head. For example, corners 160 may have a flat surface extending across the corner at a 45 degree angle relative to the adjacent side surfaces 157 and 158 to form a chamfer. In general, corners 160 may be "sharp" (little or no radius) if the corners 160 are not utilized to retain sander 150 on a drywall sander (e.g., surfaces 157 and 158 are spaced apart less than the dimension of a drywall sander head), or the corners 160 may be radiused or have some other shape that creates interference with the corners of a drywall sander head to retain the sander 150 on a drywall sander head. The corners of a rectangular drywall sander deform (compress) the foam material at radiused corners 160, and the foam material wraps around the corners of the sanding head, thereby retaining sander 150 on the drywall sanding head. Further, the sander 150 may include an undercut channel or slot extending around the sidewalls 157 and 158. When configured in this way, sander 150 has a cross-sectional shape that is substantially similar to the cross-sectional shape of sander 101 shown in FIG. 13.

The sander 150 may be quickly and easily attached to a variety of commercially available drywall sanders, and the sander 150 provides access to surfaces having limited access.

Sander 101 provides substantially the same advantages as sanding pad 110 described above. For example, the main surface 153 is substantially wider than the sanding head 120 and thereby forms wings that stabilize the sanding head to permit circular sanding motion and/or motion across the short dimension of the sanding head without flipping the sanding head over. Sander 101 also provides for sanding adjacent transverse surfaces in corners, around door frames, and the like, without marking or damage to the transverse surfaces.

With further reference to FIGS. 19-22, a multi-piece sanding pad 200 according to another aspect of the present invention includes a base 201, and a retainer 202 that is adhesively secured to the base 201. Base 201 and retainer 202 comprise a resilient foam material. Base 201 includes abrasive material 203 that is disposed on a substantially planar lower side 204 of base 201, and on angled side surfaces 205, 206, 207, and 208, of base 201. Upper side surface 209 of base 201 is generally planar, and it comprises resilient foam 210 forming the core of base 201.

Figure 20:
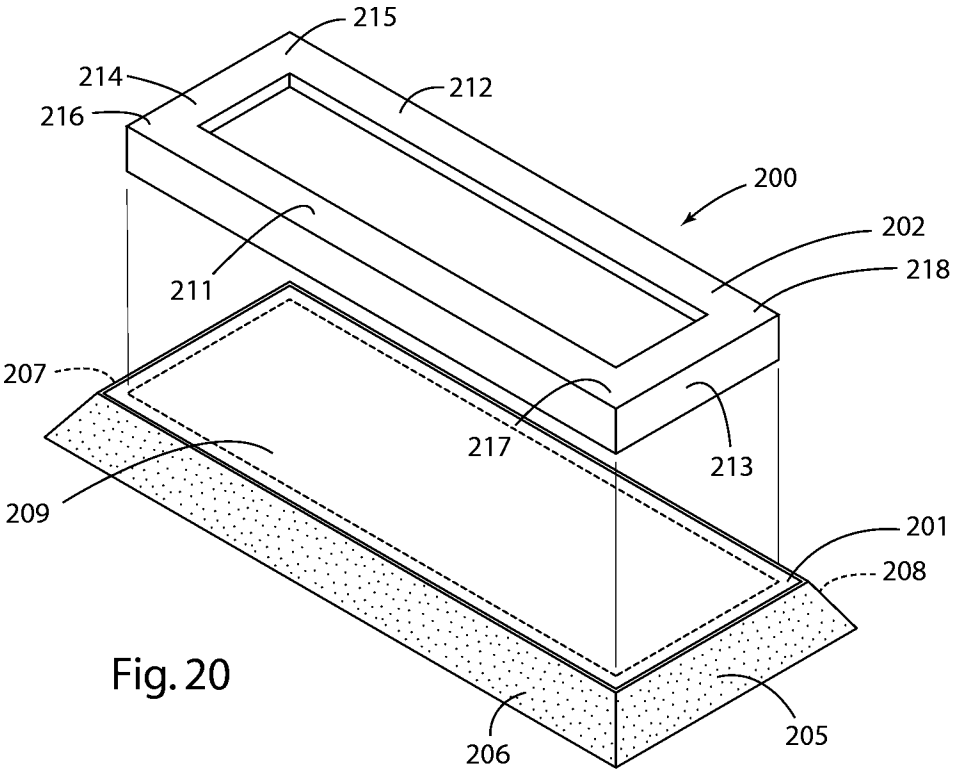
FIG. 20 is an exploded isometric view of the sanding pad of FIG. 19.
Figure 21:
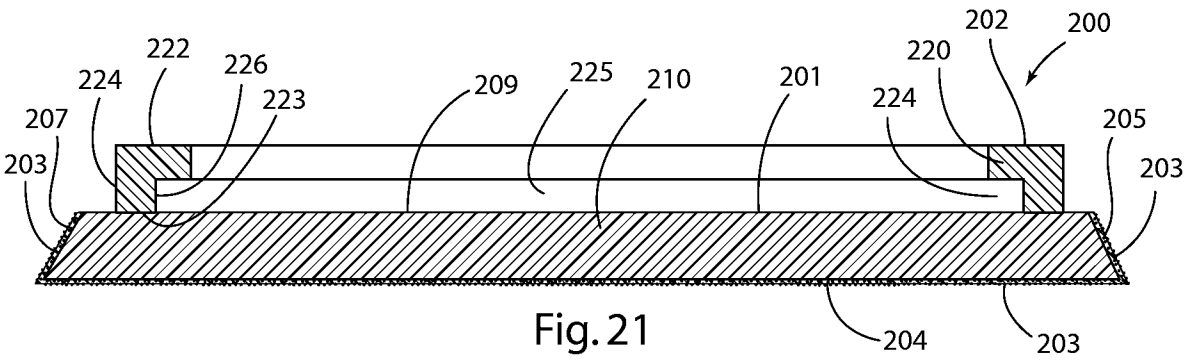
FIG. 21 is a cross-sectional view of the sanding pad of FIG. 19 taken along the line XXI-XXI.
Figure 22:
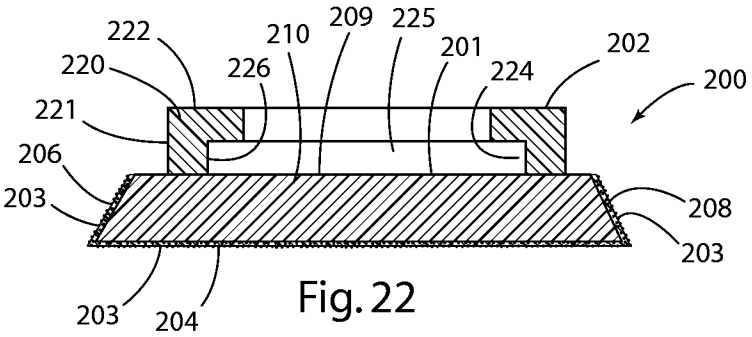
FIG. 22 is a cross-sectional view of the sanding pad of FIG. 19 taken along the line XXII-XXII.

With reference to FIG. 20, retainer 202 comprises a one piece ring-like foam structure having an appearance that is somewhat similar to a picture frame. Retainer 202 includes elongated side portions 211 and 212 that are integrally interconnected with elongated end portions 213 and 214 at corners 215-218. Retainer 202 is made of a resilient foam material 220 (FIG. 22) that may be identical to the foam 210 that forms base 201. Alternately, foam 210 and foam 220 could have different compositions. Referring again to FIGS. 21 and 22, the elongated portions 211-214 of retainer 202 have an L-shaped cross-section with a vertical leg 221 and a horizontal leg 222. Lower surface 223 of retainer 202 is adhesively retained to upper side surface 209 of base 201. Various adhesives may be utilized to secure retainer 202 to base 201. However, a general purpose adhesive spray available from 3M Corporation of St. Paul, Minn., is presently preferred.

Figure 14:
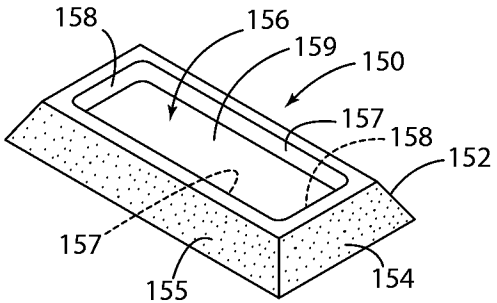
FIG. 14 is a perspective view of a sander according to another aspect of the present invention.
Figure 15:
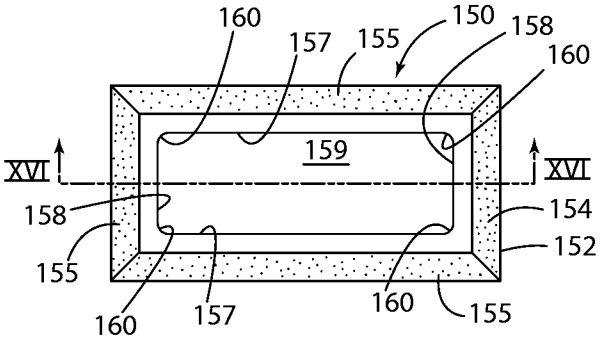
FIG. 15 is a plan view of the sander of FIG. 14.

Retainer 202 and upper side surface 209 of base 201 together form an inwardly-facing groove 224 (FIGS. 21 and 22) that extends around a pocket 225 formed by retainer 202 and base 201. In general, pocket 225 is similar to the pocket of sander 101 described in more detail above in connection with FIGS. 9-13. However, unlike the pocket of sander 101, pocket 225 of sanding pad 200 includes corners 228-231 formed by corners 215-218 of retainer 202. Inwardly-facing surface 226 of groove 224 extends around the perimeter of pocket 225. The inwardly facing surface 226 may have a rectangular shape in plan view that closely corresponds to the shape of rectangular drywall sanding heads as discussed above in connection with FIG. 11. The inwardly-facing surface 226 may include radiuses at corners 215-218 of sanding pad 200 that are substantially similar to radiused corners 160 of sander 150 as shown in FIGS. 14 and 15. The radiused corners of groove 224 are deformed upon insertion of a rectangular drywall sanding head into pocket 225, thereby tensioning retainer 202 along elongated sides 211 and 212, and along elongated ends 213 and 214. This tension assists in retaining the sanding pad 200 on the drywall sanding head, and also assists in retaining lower side surface 204 of base 201 in a planar shape.

In use, base 201 and retainer 202 are stretched and/or flexed to permit insertion of a rectangular sanding head of a drywall sander that may be of the type described above in connection with FIG. 11. The multi-piece sanding pad 200 of FIGS. 19-22 is attached to a drywall sander (e.g., drywall sanders 120 and 124 of FIG. 11) in a similar manner as drywall sander 101 as described above in connection with FIG. 12. However, because multi-piece sanding pad 200 has closed corners 215-218, the multi-piece sanding pad 200 may require additional stretching and/or flexing to permit insertion of the drywall sanding head into pocket 225.

Figure 17:
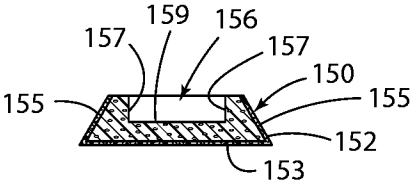
FIG. 17 is a cross-sectional view of the sander of FIG. 16 taken along the line XVII-XVII.
Figure 16:
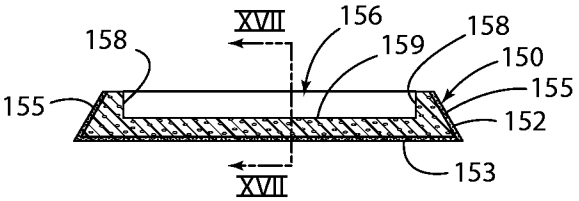
FIG. 16 is a cross-sectional view of the sander of FIG. 15 taken along the line XVI-XVI.
Figure 23:
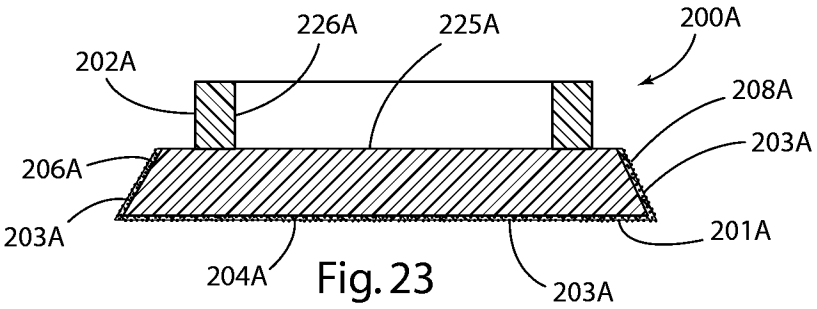
FIG. 23 is a cross-sectional view of a multi-piece sanding pad according to another aspect of the present invention.

With further reference to FIG. 23, a multi-piece sanding pad 200A according to another aspect of the present invention includes a base 201A that is substantially the same as base 201 described in more detail above in connection with FIGS. 19-22. However, retainer 202A has a substantially rectangular cross-sectional shape rather than the L-shape of retainer 202 described above. Inwardly facing surfaces 226A define a pocket 225A. The pocket 225A may have substantially the same shape and size as the cavity 156 of sander 150 (FIGS. 15-17). Retainer 202A is adhesively secured to base 201A in substantially the same manner as retainer 202 is secured to base 201.

Figure 24:
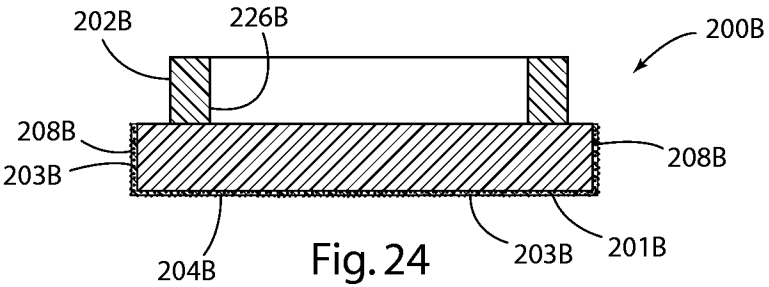
FIG. 24 is a cross-sectional view of a multi-piece sanding pad according to another aspect of the present invention.

With further reference to FIG. 24, a multi-piece sanding pad 200B according to another aspect of the present invention includes a retainer 202B that is substantially the same as retainer 202A of FIG. 23. Base 201B is similar to bases 201 and 201A, except that side surfaces 205B-208B of base 201 extend perpendicular relative to lower side 204B.

Figure 25:
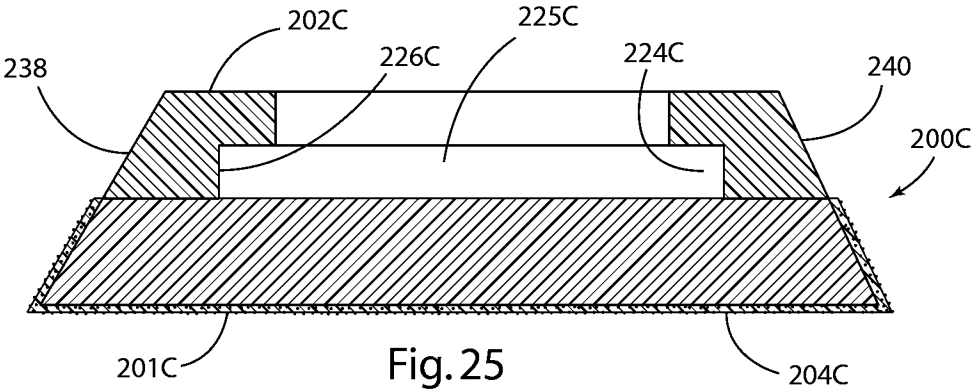
FIG. 25 is a cross-sectional view of a multi-piece sanding pad according to another aspect of the present invention.

With further reference to FIG. 25, a multi-piece sanding pad 200C according to another aspect of the present invention includes a base 201C that is substantially identical to the base 201 described in more detail above in connection with FIGS. 19-22. Retainer 202C may comprise a continuous ring-like structure, or it may comprise individual pieces 235-238 that are adhesively bonded to upper side surface 209 of base 201C. The individual pieces 235-238 may be configured to provide a shape that is substantially similar to that of sander 101 (FIG. 12). However, the individual pieces 235-238 do not include an abrasive outer surface, and surfaces 239-242 may comprise foam. Pocket 225C may have substantially the same configuration as pocket 225 of sander 200 (FIGS. 19-22).

Figure 27:
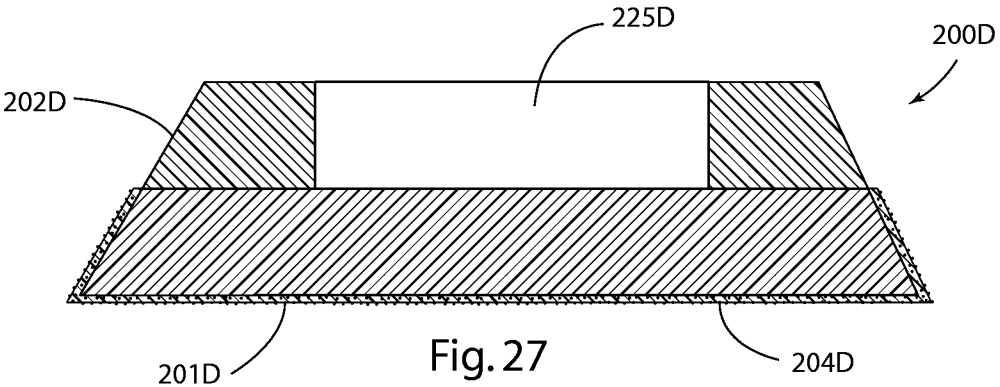
FIG. 27 is a cross-sectional view of a multi-piece sanding pad according to another aspect of the present invention.
Figure 26:
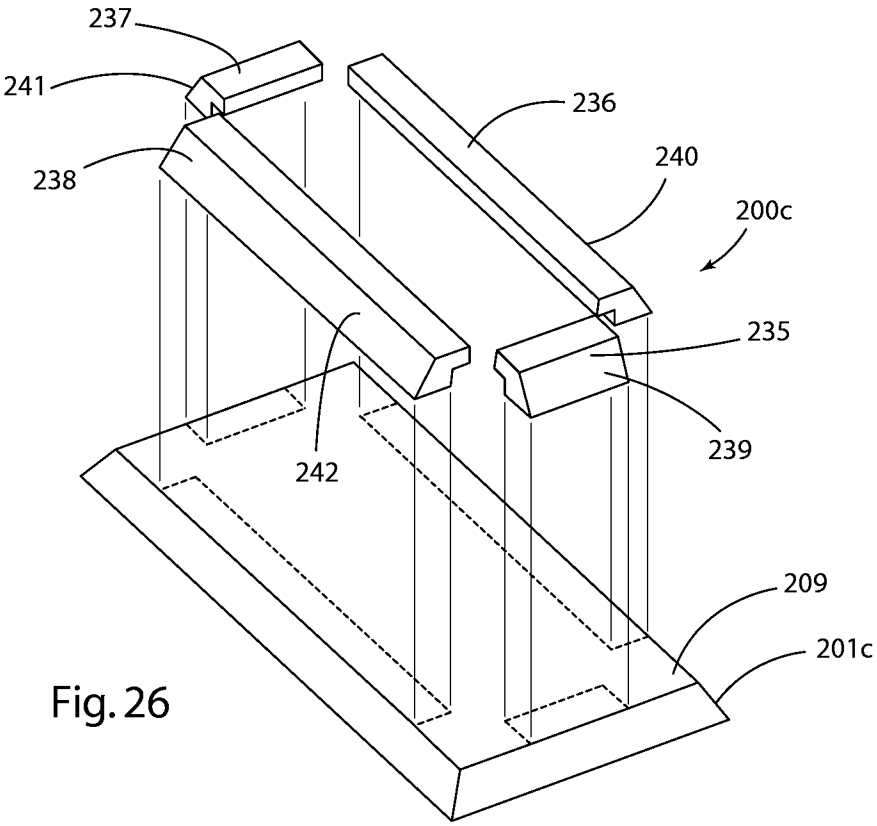
FIG. 26 is an exploded isometric view of a multi-piece sanding pad according to another aspect of the present invention.

With further reference to FIG. 27, a multi-piece sanding pad 200D according to another aspect of the present invention includes a base 201D that may be substantially similar to the base 201 of sander 200 (FIGS. 19-22). Sanding pad 200D includes a retainer 202D that is adhesively bonded to base 201D to define a pocket 225D that may be substantially similar in shape and size to pocket 225A (FIG. 23). Retainer 202D may comprise a continuous, ring-like structure, or it may comprise a multi-piece structure that is similar to the retainer of sanding pad 200C (FIG. 26).

The multi-piece sanding pads of FIGS. 19-27 utilize a multi-piece construction to form a pocket that receives a drywall sanding head in a manner that is similar to the sanders described above in connection with FIGS. 9-18. However, the multi-piece sanding pads of FIGS. 19-27 do not require removal of foam material to form pockets for receiving drywall sanders.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A sanding pad for attachment to a drywall sander head of the type having an outer edge forming a generally quadrilateral perimeter, the sanding pad comprising:

a body portion comprising a resiliently deformable foam core material, the body portion defining a first outer side that faces in a first direction, the body portion defining a second outer side that is parallel to the first outer side and faces in a second direction that is generally opposite the first direction, wherein the first outer side having a substantially planar first side surface and defines generally parallel opposite edges, the body portion further including generally planar opposite side surfaces extending from the second outer side to the first outer side and intersecting the first outer side along the opposite edges, and wherein the opposite sides intersect the first side surface to define acute angles whereby the opposite edges are sharp to permit sanding a first wall at an inside corner without marking or damage to a second wall that is orthogonal to the first wall and intersects the first wall along the corner;

abrasive material disposed on at least a portion of the first side; and wherein:

the body portion includes a pocket defined by the resiliently deformable foam core material in the second side that opens in the second direction, to receive a portion of an outer edge of a drywall sander head to retain the sanding pad on the drywall sander head.

2. The sanding pad of claim 1, wherein:

the pocket includes a first pair of spaced apart inner sides that generally face one another, and a second pair of spaced apart inner sides that generally face one another, and a base side extending between the first and second pairs of inner sides, wherein at least one of the inner sides includes an inwardly-facing groove; and each of the inner sides of the first pair include inwardly-facing grooves configured to receive opposite outer edges of a drywall sander head.

3. The sanding pad of claim 2, wherein:

each of the inner sides of the second pair include inwardly-facing grooves configured to receive opposite outer edges of a drywall sander head.

4. The sanding pad of claim 2, wherein:

the first pair of inner sides are spaced apart to form a gap that is generally T-shaped in cross section.

5. The sanding pad of claim 3, wherein:

the second pair of inner sides are spaced apart to form a gap that is generally T-shaped in cross section.

6. A sanding pad for attachment to a drywall sander head of the type having an outer edge forming a generally quadrilateral perimeter, the sanding pad comprising:

a body portion comprising a resiliently deformable foam core material, the body portion defining a first outer side that faces in a first direction, the body portion defining a second outer side that is parallel to the first outer side and faces in a second direction that is generally opposite the first direction;

wherein abrasive material is disposed on at least a portion of the first side;

the body portion includes a pocket defined by the resiliently deformable foam core material in the second side that opens in the second direction, the pocket having a first pair of spaced apart inner sides that generally face one another, and a second pair of spaced apart inner sides that generally face one another, and a base side extending between the first and second pairs of inner sides, wherein at least one of the inner sides includes an inwardly-facing groove that is configured to receive a portion of an outer edge of a drywall sander head to retain the sanding pad on the drywall sander head; and wherein the body portion comprises a base and a retainer that is adhesively secured to the base to define the inwardly-facing groove.

7. The sanding pad of claim 6, wherein:

the retainer and the base comprise a foam material.

8. The sanding pad of claim 6, wherein:

the retainer comprises four elongated portions that are joined at opposite ends to form a generally rectangular ring structure, wherein each of the elongated portions is generally L-shaped in cross section.

9. The sanding pad of claim 1, wherein:

the body portion has an integrally formed one piece core formed from the resiliently deformable foam core material.

10. The sanding pad of claim 1, wherein:

the first outer side defines a generally quadrilateral perimeter.

11. The sanding pad of claim 1, wherein:

the acute angles are in a range of about forty-five degrees to about eighty-five degrees.

12. The sanding pad of claim 1, wherein:

the acute angles are about sixty-five degrees.

13. The sanding pad of claim 1, wherein:

the body portion includes a second pair of generally planar opposite side surfaces that intersect the first side surface at acute angles to form sharp end edges extending between the opposite edges.

14. The sanding pad of claim 13, wherein:

the acute angles are about sixty-five degrees.

15. The sanding pad of claim 1, wherein:

the second outer side includes a planar surface that is parallel to the first side surface.

16. The sanding pad of claim 15, wherein:

the pocket is quadrilateral in plan shape with foam material at each corner defining a radius that deforms upon insertion of a sanding head and thereby retains the sanding pad on a sanding head.

17. A sanding pad for attachment to a drywall sander head of the type having a generally quadrilateral perimeter, the sanding pad comprising:

a body portion comprising a resiliently deformable core material, the body portion defining a generally planar first side surface having a generally quadrilateral perimeter, the body portion defining a second side that faces opposite the first side surface, the second side including a second side surface;

abrasive material disposed on at least a portion of the first side surface; and wherein:

the body portion includes a generally quadrilateral pocket in the second side, the pocket having a first pair of opposing side surfaces generally facing one another, and a second pair of opposing side surfaces generally facing one another, and a base surface extending between the first and second pairs of opposing side surfaces, wherein the base surface is spaced inwardly from the second side surface, and wherein the pocket defines four corner portions, wherein each corner portion includes corner material extending between adjacent side surfaces such that adjacent side surfaces do not form sharp corners, whereby the corner material is deformed by the corners of a drywall sander head when the sanding pad is attached to a drywall sanding head.

18. The sanding pad of claim 17, wherein:

the pocket has a substantially uniform cross-sectional shape.

19. The sanding pad of claim 17, wherein:

the corner material forms a concave curved surface at each corner.

20. The sanding pad of claim 19, wherein:

each concave curved surface has a radius of at least about 0.25 inches.

21. The sanding pad of claim 17, wherein:

the opposing side surfaces and the base surface are planar.

22. The sanding pad of claim 17, wherein:

the body portion comprises a base portion and a retainer portion that is adhesively bonded to the base portion.

* * * * *